US007841192B2

(12) United States Patent
Rafalovich et al.

(10) Patent No.: US 7,841,192 B2
(45) Date of Patent: Nov. 30, 2010

(54) ICE IN BUCKET DETECTION FOR AN ICEMAKER

(75) Inventors: Alexander Pinkus Rafalovich, Louisville, KY (US); Robert Catlett, Lexington, KY (US); John Kenneth Hooker, Louisville, KY (US); Toby Whitaker, Loveland, CO (US)

(73) Assignee: General Electric Company, Schenectady, NY (US)

( * ) Notice: Subject to any disclaimer, the term of this patent is extended or adjusted under 35 U.S.C. 154(b) by 381 days.

(21) Appl. No.: 11/965,344

(22) Filed: Dec. 27, 2007

(65) Prior Publication Data

US 2009/0165471 A1 Jul. 2, 2009

(51) Int. Cl.
*F25C 5/18* (2006.01)

(52) U.S. Cl. ..... 62/135; 62/344

(58) Field of Classification Search ..... 62/135, 62/137, 344

See application file for complete search history.

(56) References Cited

U.S. PATENT DOCUMENTS

| | | | | | |
|---|---|---|---|---|---|
| 3,327,493 | A | * | 6/1967 | Jacobus | 62/137 |
| 3,611,741 | A | * | 10/1971 | William | 62/137 |
| 3,635,043 | A | * | 1/1972 | Sterling | 62/137 |
| 3,885,937 | A | * | 5/1975 | Norris | 62/137 |
| 6,286,324 | B1 | | 9/2001 | Pastryk et al. | |

* cited by examiner

*Primary Examiner*—William E Tapolcai
(74) *Attorney, Agent, or Firm*—Global Patent Operation; Douglas D. Zhang

(57) ABSTRACT

In an embodiment of the invention, a refrigerator comprising an ice storage bucket and a cooling system in thermal communication with the ice storage bucket is shown. A first transmitter is configured in the ice storage bucket. A first pulse signal is transmitted from the first transmitter. A first receiver is configured in the ice storage bucket and is further configured to receive the first pulse signal. A first pre-signal response from the first receiver is generated before the first pulse signal. A first pulse signal response from the first receiver generated during the first pulse signal.

13 Claims, 7 Drawing Sheets

ICE IN BUCKET DETECTION FOR AN ICEMAKER

FIELD OF THE INVENTION

The invention relates to appliances. More specifically the invention relates to appliances that include detectors for determining the volume of ice present in a bucket for a refrigerator icemaker.

BACKGROUND OF THE INVENTION

In a known appliance, such as a refrigerator, an icemaker delivers ice through an opening in a door of the refrigerator. Such a known refrigerator has a freezer section to the side of a fresh food section. This type of refrigerator is often referred to as a "side-by-side" refrigerator. In the side-by-side refrigerator, the icemaker delivers ice through the door of the freezer section. In this arrangement, ice is formed by freezing water with cold air in the freezer section, the air being made cold by a cooling system that includes an evaporator.

Another known refrigerator includes a bottom freezer section disposed below a top fresh food section. This type of refrigerator is often referred to as a "bottom freezer" or "bottom mount freezer" refrigerator. In this arrangement, convenience necessitates that the icemaker deliver ice through the opening in the door of the fresh food section, rather than the freezer section. However, the cool air in the fresh food section is generally not cold enough to freeze water to form ice.

In the bottom freezer refrigerator, it is known to pump cold air, which is cooled by the evaporator of the cooling system, within an interior channel of the door of the fresh food section to the icemaker.

These prior art arrangements suffer from numerous disadvantages. For example, complicated air ducts are required within the interior of the door for the cold air to flow to the icemaker. Further, ice is made at a relatively slow rate, due to limitations the storage volume for the ice and/or temperature of cold air that can be pumped within the interior of the door of the fresh food section. Another disadvantage is that pumping the cold air to the fresh food compartment during ice production reduces the temperature of the fresh food compartment below the set point.

Further, when ice is made and stored in the fresh food compartment of the refrigerator, continued cooling of the ice bucket is required to prevent melting of the ice. The melting of the stored ice is particularly a problem when the user turns off the icemaker. Prior art devices use one of two methods to manage stored ice when the icemaker is turned off.

One method eliminates cooling flow to the icemaker. This method has the benefit of reducing energy consumption. However, without cooling flow, the ice melts. The melted ice is typically allowed to drain into the drain pan of the refrigerator for evaporation. However, if a significant volume of ice was in the ice bucket the drain pan overflows onto the floor.

The second method used to manage stored ice when the icemaker is turned off is to continue to cool the ice bucket. This method eliminates the melting of the ice and ensuing mess. However this method continues to expend energy cooling the ice bucket even if there is no ice present.

SUMMARY OF THE INVENTION

Therefore, in an embodiment of the invention, a refrigerator comprising an ice storage bucket and a cooling system in thermal communication with the ice storage bucket is shown. A first transmitter is configured in the ice storage bucket. A first pulse signal is transmitted from the first transmitter. A first receiver is configured in the ice storage bucket and is further configured to receive the first pulse signal. A first pre-signal response from the first receiver is generated before the first pulse signal. A first pulse signal response from the first receiver generated during the first pulse signal.

In another embodiment of the invention, a method is used for providing cooling to an ice storage bucket. A first pre-pulse response is received from a first receiver. A pulse signal is transmitted from a first transmitter. The first pulse signal is received as a first pulse response from the first receiver. A first difference is compared between the first signal response and the first pre-signal response. Cooling is enabled where the first difference is greater then a first predetermined difference.

In a further embodiment of the invention, a device for detecting ice in an ice storage bucket comprises a first transmitter and a first receiver configured in the ice storage bucket. A first pulse signal is transmitted from the first transmitter. The first receiver is further configured to receive the first pulse signal. A first pre-signal response from the first receiver is generated before the first pulse signal. A first pulse signal response from the first receiver is generated during the first pulse signal. A cooling system is in thermal communication with the ice storage bucket.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

It is contemplated that the teaching of the description set forth below is applicable to all types of refrigeration appliances, including but not limited to side-by-side and top mount refrigerators wherein undesirable temperature gradients exist within the compartments. The present invention is therefore not intended to be limited to any particular type or configuration of a refrigerator, such as refrigerator 100.

Figure 1:
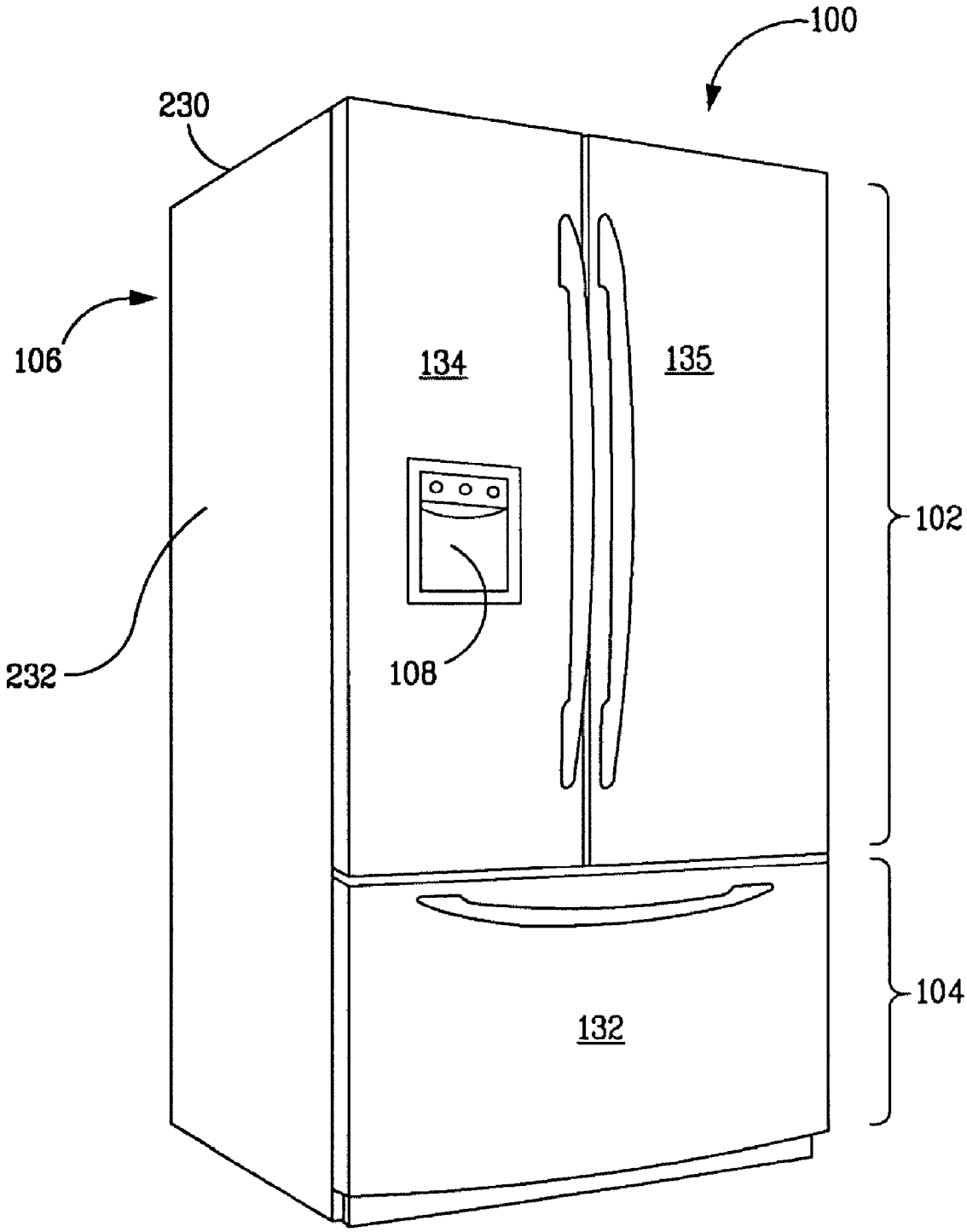
FIG. 1 is a perspective view of a refrigerator.
Figure 2:
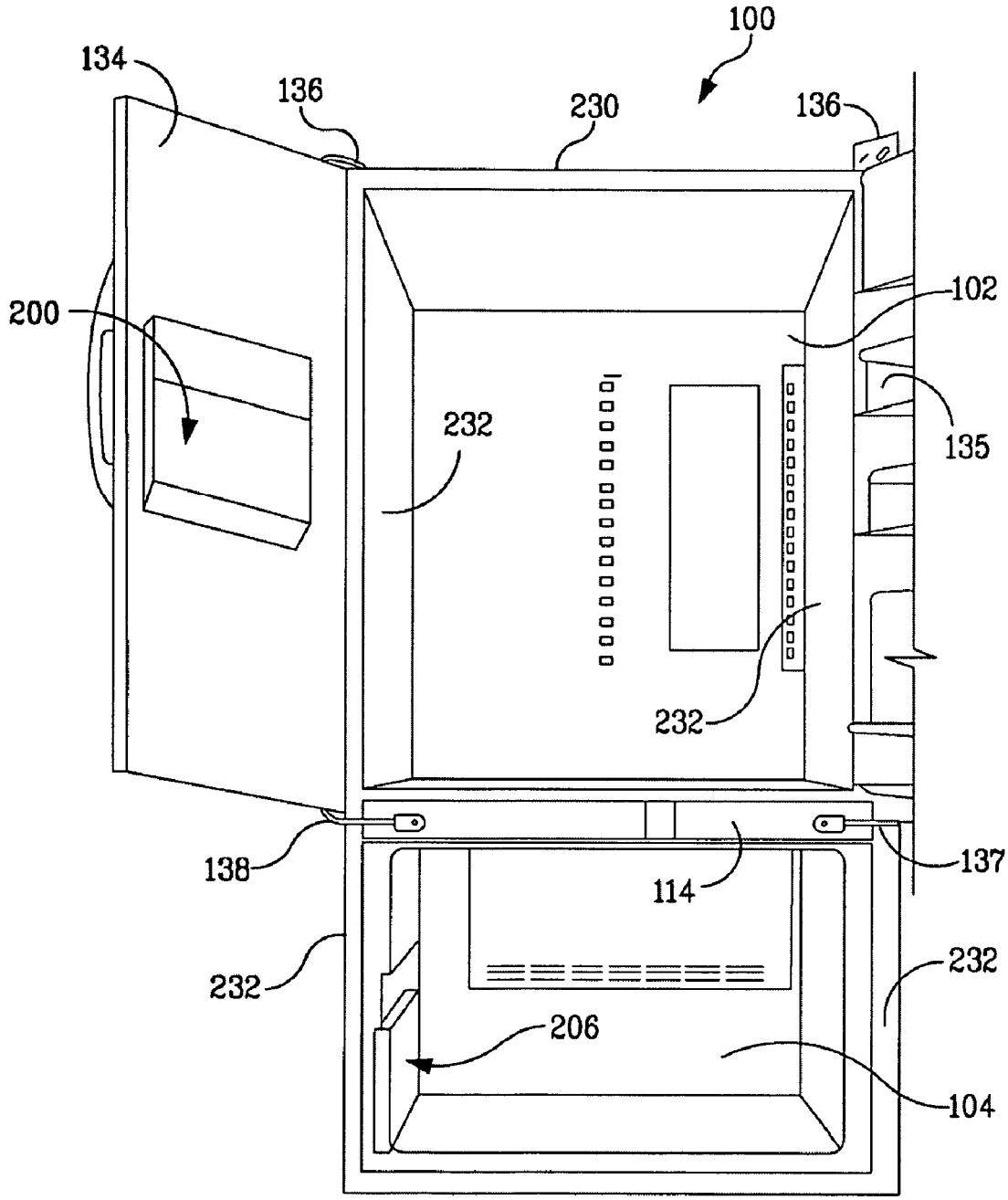
FIG. 2 is a perspective view of a refrigerator of FIG. 1 with the doors open.

FIGS. 1 and 2 illustrate a bottom mount freezer refrigerator 100 including a fresh food compartment 102 and freezer compartment 104. Freezer compartment 104 and fresh food compartment 102 are arranged in a bottom mount configuration where the freezer compartment 104 is below the fresh food compartment 102. The fresh food compartment is shown with French opening doors 134 and 135. However, a single door may be used. Door or drawer 132 closes freezer compartment 104.

The fresh food compartment 102 and freezer compartment 104 are contained within an outer case 106. Outer case 106 normally is formed by folding a sheet of a suitable material, such as pre-painted steel, into an inverted U-shape to form top and sidewalls 230, 232 of case 106. Mullion 114, shown in FIG. 2, is preferably formed of an extruded ABS material. Mullion 114 separates the fresh food compartment 102 and the freezer compartment 104.

Door 132 and doors 134, 135 close access openings to freezer and fresh food compartments 104, 102, respectively. Each door 134 and 135 is mounted by a top hinge 136 and a bottom hinge 137 to rotate about its outer vertically oriented edge between an open position, as shown in FIG. 2, and a closed position shown in FIG. 1 closing the associated storage compartment. Door 134 is configured with a dispensing center 108 for through the door ice service. Dispensing center 108 may further contain beverage service, such as for hot or cold water, juices or other beverages.

In accordance with known refrigerators, refrigerator 100 also includes a machinery compartment (not shown) that at least partially contains components for executing a known vapor compression cycle for cooling air in the compartments. The components include a compressor (not shown), a condenser (not shown), an expansion device (not shown), and an evaporator (not shown) connected in series and charged with a refrigerant. The evaporator is a type of heat exchanger that transfers heat from air passing over the evaporator to a refrigerant flowing through the evaporator, thereby causing the refrigerant to vaporize. The cooled air is used to refrigerate one or more fresh food or freezer compartments via fans (not shown). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator 100.

Figure 3:
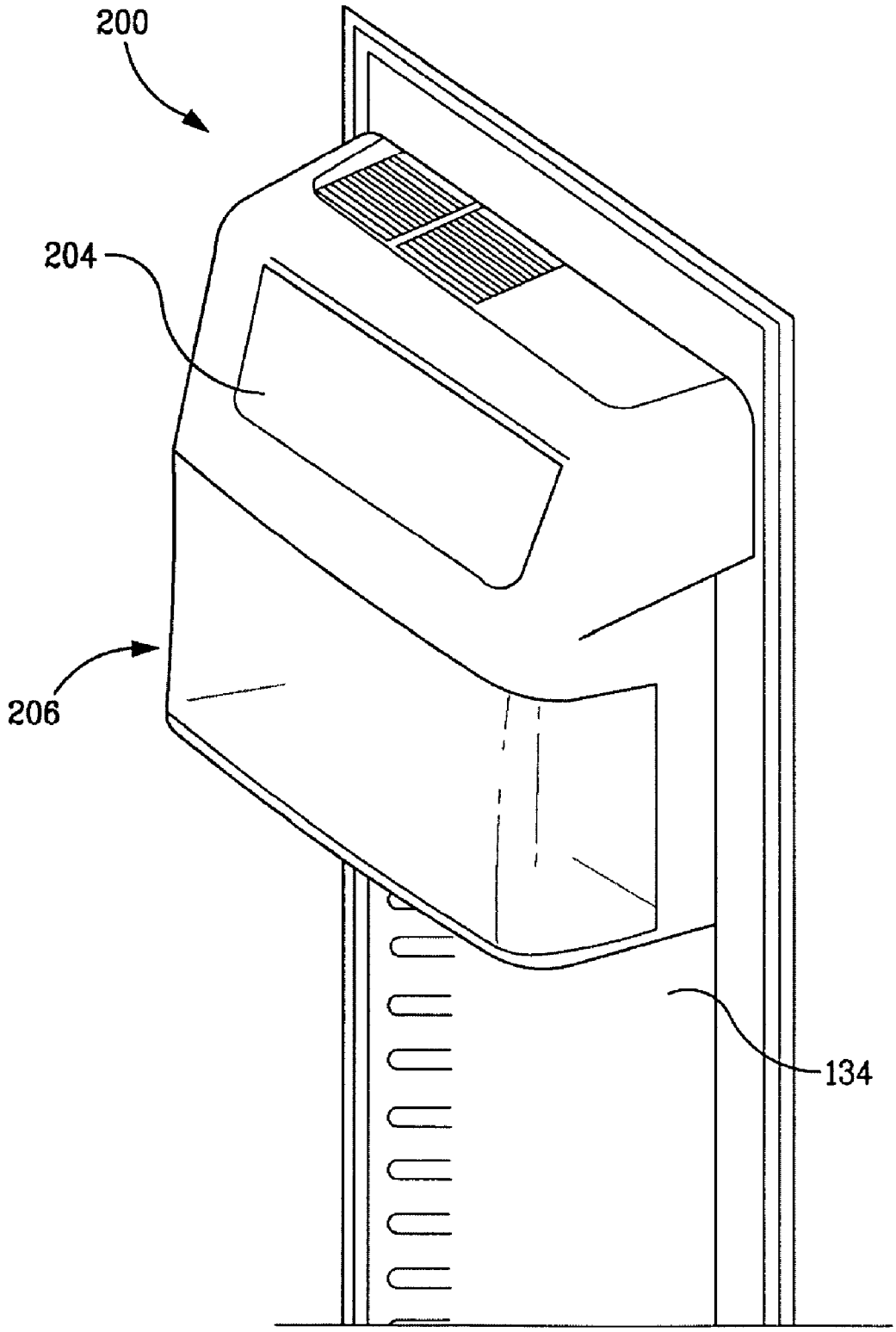
FIG. 3 is a perspective view of an exemplary icemaker incorporated into a refrigerator of FIG. 1.

FIG. 3 shows a typical arraignment for an ice making and storage compartment 200 mounted on the inside of a door 134 of the fresh food compartment 102. Ice making and storage compartment 200 has an icemaker 204 and an ice bucket 206. Ice making and storage compartment 200 may also have an ice chute (shown in FIG. 4 as 203) for through the door beverage and ice serve at a dispensing center 108. Supplying ice through the door of a refrigerator is known and will not be described in detail. It can be appreciated that the means for cooling the ice making and storage compartment 200 may be any known means, including but not limited to, forced air circulation or a secondary fluid-cooling loop such as a glycol loop in combination with the vapor-compression loop of the refrigerator.

Figure 4:
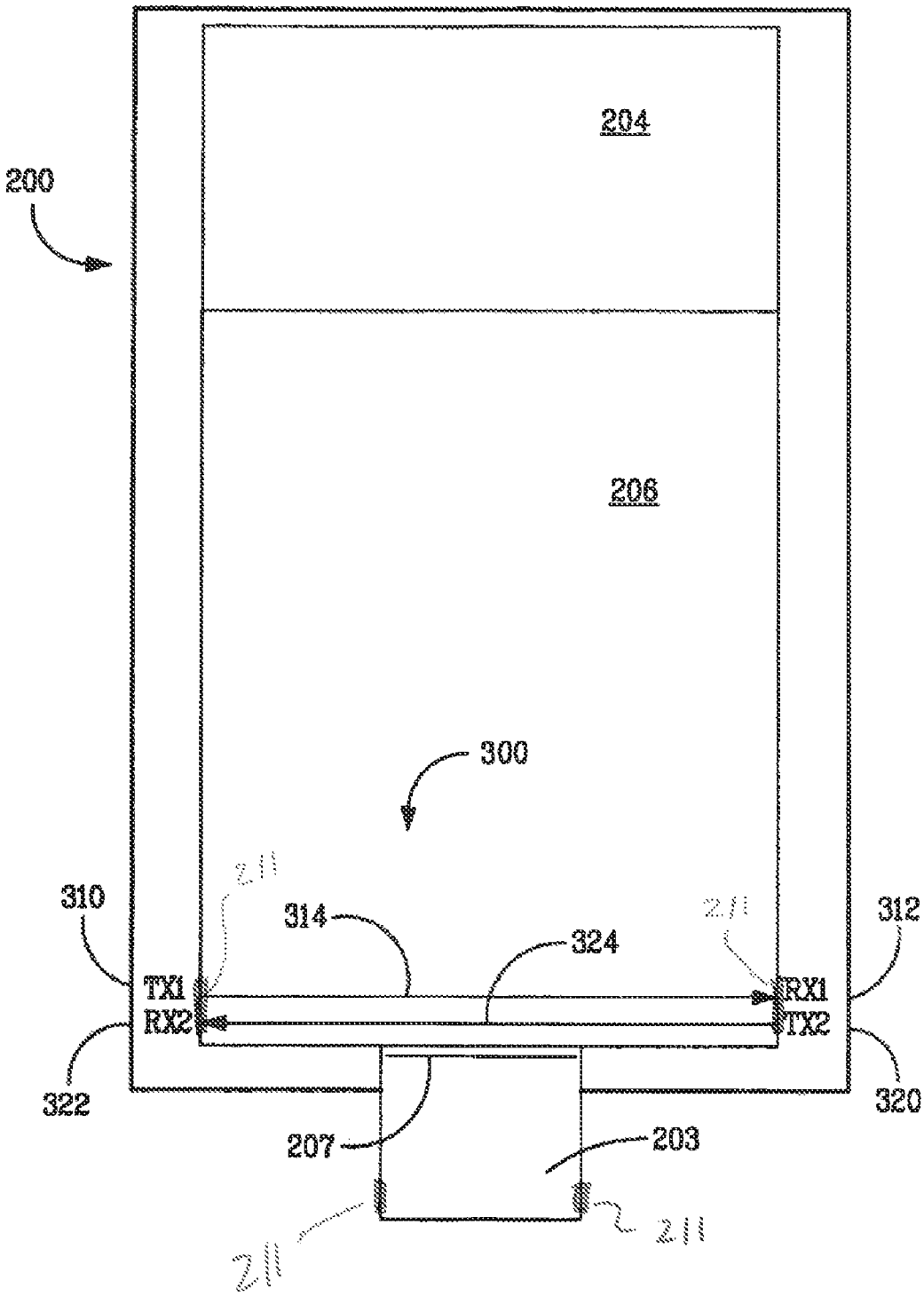
FIG. 4 is a schematic representation of the icemaker of FIG. 3 with incorporated ice in bucket detection means according to an aspect of the invention.

FIG. 4 shows an embodiment of the ice in bucket detection for an ice making and storage compartment 200 of the present invention. It should be understood that the term "ice" as used in the description of the present invention is intended to comprise more than water in its frozen state, but shall be broadly construed to comprise any volume of matter in a defined container or volume such as bucket 206. Ice present in the bucket 206 of the ice making and storage compartment 200 is detected by optical system 300. The optical system 300 creates invisible infrared (IR) beams 314, 324 at infrared transmitters 310 and 320. The infrared beams 314 and 324 cross the bottom of the ice bucket 206 or in the ice chute 203 to receivers 312 and 322 to detect whether any ice is in the bucket 206. Slots 211 defined in the sidewalls of the ice bucket 206 and ice chute 203 allow projection of the beams through the ice bucket and ice chute to the receivers 312 and 322. As shown, more than one beam 314 or 324 may be used to increase the probability of detecting ice. However, one or more than two beams may be used in different location to detect ice within the ice making and storage compartment 200 or chute 203. When any of the beams 314 or 324 are interrupted, cooling of the bucket 206 is enabled to prevent melting of the ice. If no ice is detected and the ice producing portion 204 of the ice making and storage compartment 200 is off, than bucket cooling is disabled to reduce energy consumption.

Figure 5:
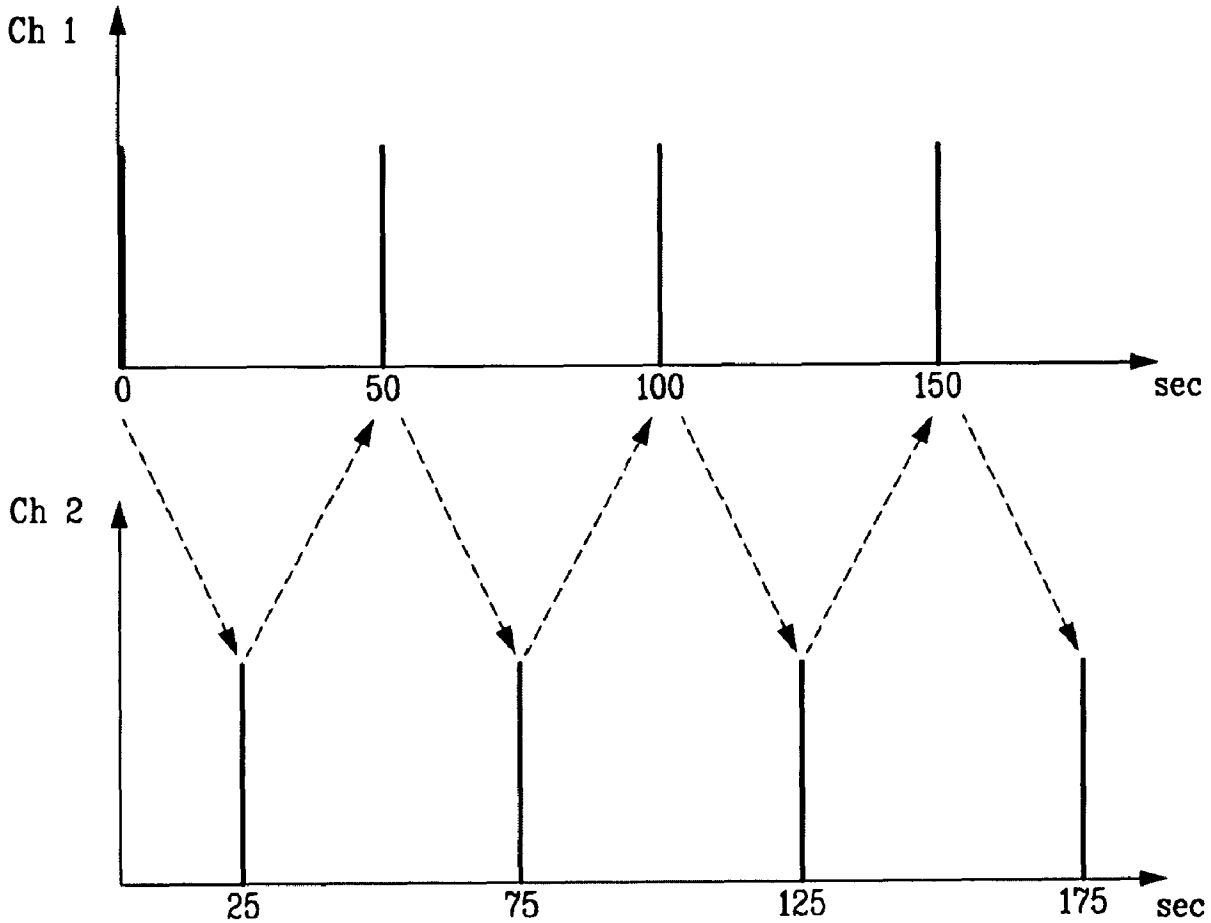
FIG. 5 shows the timing of the pulses of the ice in the ice bucket detection means of FIG. 4.

The use of a transmitter and receiver pair 310, 322 and 320, 312 on each side of the ice making and storage compartment 200 allows for a common assembly on each icemaker side and increases the chance of detecting a small volume of ice. For a two (or more) channel system, the channels are pulsed independently and alternately, as shown in FIG. 5, to avoid interference between the channels. While, the channels are shown pulsed at a 50 second interval per channel, any suitable pulse rate may be used. The method of detection of the present embodiment will be described in greater detail below. The optical system of the present embodiment utilizes light emitting diodes or LED's as transmitters 310, 320 and inferred detectors as receivers 312, 322.

Figure 6:
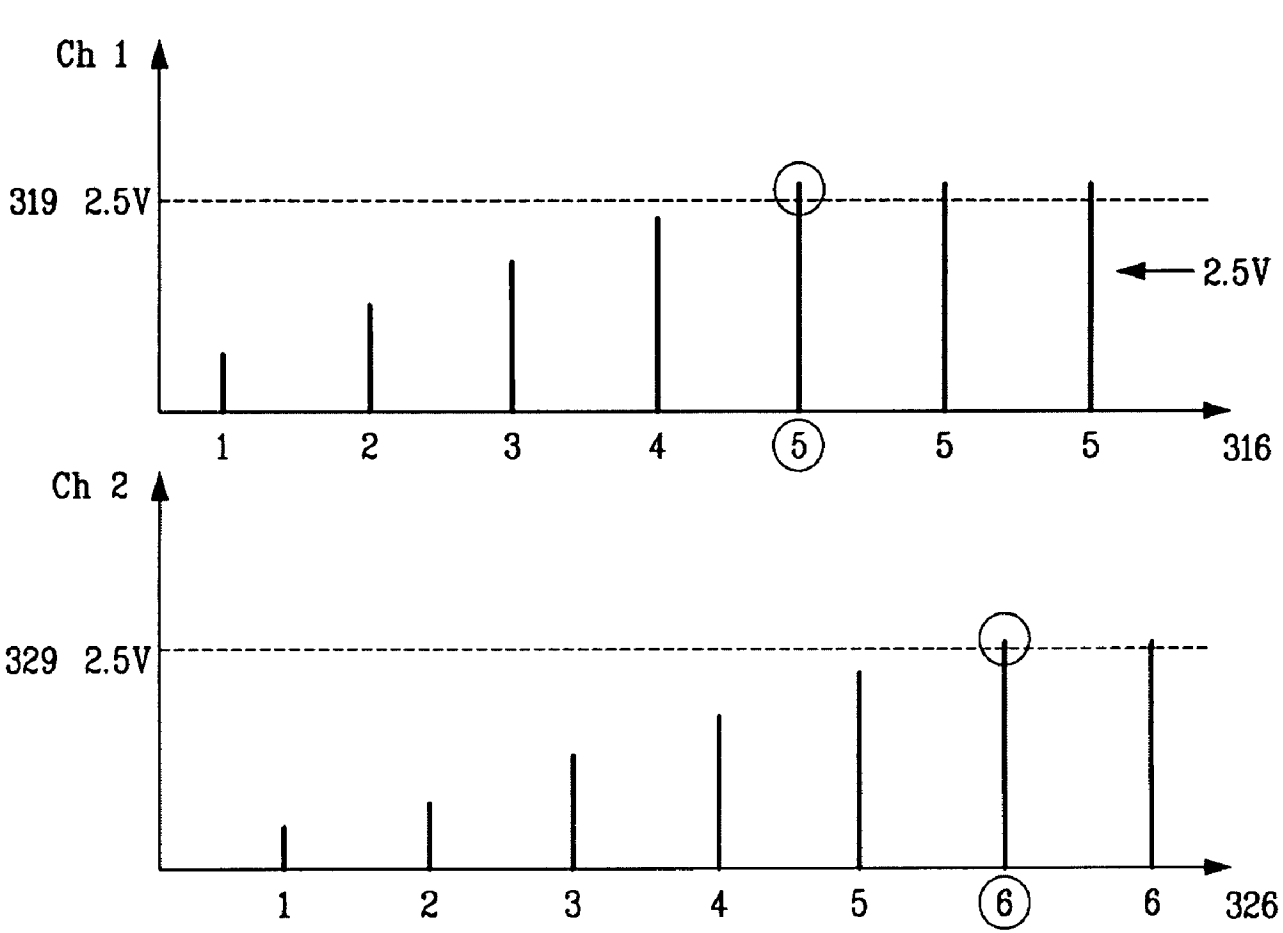
FIG. 6 shows a calibration sequence according to an aspect of the invention.

At power-up, a calibration procedure is performed to determine the proper drive level for each of the transmitters 310, 320 to achieve proper photodiode response when no ice or blockage is present. During calibration, as shown in FIG. 6, the current of each transmitter 310, 320 is changed, increasingly, until a proper response is received from the receiver 312, 322. FIG. 6 shows an exemplary calibration of a 2-channel system. The graph of channel 1 indicates the expected response from the receiver 312 is 2.5 volt, shown at 319. The response 319 need not be 2.5 volt specifically, and may be any value achievable from the receiver 312 for a given transmitter 310. The current is increased at predetermined increments 316 until the response 319 is achieved. The level 319 of response value identified at five of FIG. 6 is stored in a memory of a controller (not shown). While the response level five is shown as a single digit integer representing a predetermined current, the actual current or any other designating means may be used. Likewise channel 2 is calibrated in the same manner. As shown each channel may have a different drive level 316, 326.

During operation, the transmitters are pulsed at the current determined during calibration. The pulsing transmitters 310, 320 can be very occasionally (several seconds or even minutes) and with very short duration (50 micro-seconds or less) to reduce transmitter fatigue. The interval and duration of the pulses need only be sufficient to regularly detect the presence of ice in the bucket 206. In fact, the ice detection system could remain idle, unless the ice making and storage compartment 200 is switched into an off position.

Figure 7:
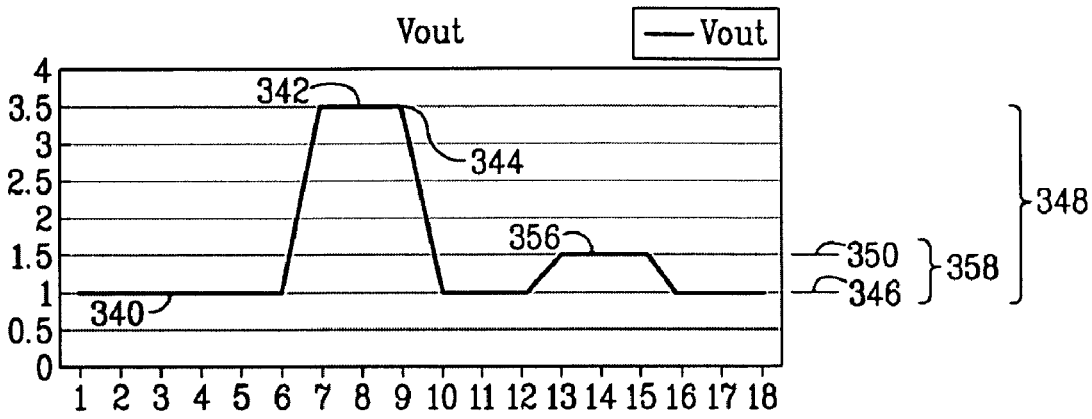
FIG. 7 is a graph of an ice detection curve.

Turning to FIG. 7, the output of the receiver is sampled by an analog to digital "A/D" converter before the pulse, identified as segment 340 and during the pulse identified at 342. By taking two samples ambient IR levels may be removed. The difference in the before 340 and during 342 pulse readings is the "delta" 348 of the output, as shown in FIG. 7. It is the delta 348 or voltage 344 (which one? the delta or voltage? need to clarify) subtracted by the voltage 346 that when compared to the calibration responses 319, 329 determines if ice is present in the bucket 206. The delta 348 of FIG. 7 is 2.5 volts or equal to the calibrated response 319, 329, therefore based on this exemplary data, no ice would be present in the bucket and therefore cooling to the bucket need not be applied.

Conversely, if the delta 358 of the during pulse 356 response and the before pulse 340 response is sufficiently small, for example as shown as 0.5 volt, such a voltage would indicate the presence of ice in the bucket 206, and cooling of the bucket 206 would turned on.

If the delta 348 is not equal to the calibrated response 319, 329 but is sufficiently smaller than an expected ice in bucket condition recalibration of the detection system may be necessary.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

The invention claimed is:

1. An ice storage compartment comprising:

an ice storage bucket;

a cooling system in thermal communication with the ice storage bucket for cooling the ice storage bucket;

an optical system disposed proximal a bottom surface of the ice storage bucket for determining whether or not there is a volume of ice in the ice storage bucket; and means for enabling the cooling system if ice is detected in the ice storage bucket for maintaining the ice in a frozen state.

2. The ice storage compartment of claim 1, wherein the cooling system is disabled if there is no ice detected in the ice storage bucket for conserving energy.

3. The ice storage compartment of claim 1, wherein the optical system includes at least one pair of a light transmitter and a corresponding receiver operable to detect the presence of a volume of ice in the ice storage bucket.

4. The ice storage compartment of claim 3, wherein the at least one pair of light transmitter and receiver are disposed near a bottom surface of the ice storage bucket adjacent opposing sidewalls thereof.

5. The ice storage compartment of claim 3, wherein the ice storage bucket defines a pair of slots in opposing sidewalls thereof for allowing light transmission through an interior of the ice storage bucket between the light transmitter and the receiver.

6. The ice storage compartment of claim 1, wherein the cooling system is controlled to shut down when there is no ice detected in the ice bucket and an associated ice maker is in an off mode.

7. The ice storage compartment of claim 3, further comprising a chute coupled to the ice storage bucket for carrying ice dispensed from the ice storage bucket, the light transmitter and receiver being mounted adjacent opposing sidewalls of the chute for detecting the presence of a volume of ice in the chute.

8. A refrigerator having a fresh food compartment and a frozen food compartment, comprising:

an ice storage compartment disposed in a door of the fresh food compartment, the ice storage compartment including, an ice storage bucket;

a cooling system in thermal communication with the ice storage bucket for cooling the ice storage bucket;

an optical system disposed proximal a bottom surface of the ice storage bucket for determining whether or not there is a volume of ice in the ice storage bucket; and means for enabling the cooling system when ice is detected in the ice storage bucket for maintaining the ice in a frozen state.

9. The refrigerator of claim 8, wherein the optical system includes at least one pair of a light transmitter and a corresponding receiver operable to detect the presence of a volume of ice in the ice storage bucket.

10. The refrigerator of claim 9, wherein the at least one pair of light transmitter and receiver are disposed near a bottom surface of the ice storage bucket adjacent opposing sidewalls thereof.

11. The refrigerator of claim 10, wherein the ice storage bucket defines a pair of slots in opposing sidewalls thereof for allowing light transmission through an interior of the ice storage bucket between the light transmitter and the receiver.

12. The refrigerator of claim 8, wherein the ice storage compartment further comprises an ice maker coupled to the cooling system for making ice for storing in the ice storage bucket.

13. The refrigerator of claim 12, wherein the cooling system is disabled when there is no ice detected in the ice bucket and the ice maker is turned off.

* * * * *